US012201885B2

(12) United States Patent
Carroll

(10) Patent No.: US 12,201,885 B2
(45) Date of Patent: Jan. 21, 2025

(54) ALIGNMENT AID ON GOLF GRIP OR GOLF SHAFT

(71) Applicant: James Howard Carroll, Lancaster, OH (US)

(72) Inventor: James Howard Carroll, Lancaster, OH (US)

( * ) Notice: Subject to any disclaimer, the term of this patent is extended or adjusted under 35 U.S.C. 154(b) by 484 days.

(21) Appl. No.: 17/565,830

(22) Filed: Dec. 30, 2021

(65) Prior Publication Data

US 2022/0203185 A1 Jun. 30, 2022

Related U.S. Application Data

(60) Provisional application No. 63/205,623, filed on Dec. 30, 2020.

(51) Int. Cl.
*A63B 69/36* (2006.01)
*A63B 53/14* (2015.01)

(52) U.S. Cl.
CPC ..... *A63B 69/3632* (2013.01); *A63B 53/14* (2013.01)

(58) Field of Classification Search
CPC ..... A63B 69/3632
See application file for complete search history.

(56) References Cited

U.S. PATENT DOCUMENTS 1,126,208 A * 1/1915 Hayford ..... A63B 60/10 473/201
1,603,850 A * 10/1926 Keating ..... A63B 69/3632 D21/759
3,848,874 A * 11/1974 Elkins, Jr. ..... A63B 69/3632 473/409
4,204,332 A * 5/1980 Gray ..... A63B 69/3632 473/238
4,222,567 A * 9/1980 Shabala ..... A63B 53/04 473/242
4,317,568 A * 3/1982 Green ..... A63B 53/007 473/238
5,158,297 A * 10/1992 Johnson ..... A63B 69/3632 473/238
5,228,695 A * 7/1993 Meyer ..... A63B 60/00 473/238
6,447,401 B1 * 9/2002 Torkos ..... A63B 69/3632 473/226
7,976,399 B1 * 7/2011 Pritchett ..... A63B 69/3632 473/238
2002/0160849 A1 * 10/2002 Thomas ..... A63B 60/02 473/226

(Continued)

OTHER PUBLICATIONS

Written Opinion of the International Searching Authority dated May 2, 2022.

*Primary Examiner* — Joshua T Kennedy
(74) *Attorney, Agent, or Firm* — Jacob M. Ward; Ward Law Office LLC

(57) ABSTRACT

An alignment aid for a golf club includes a centerline marker for marking a centerline of a shaft of a golf club, one or more alignment angle markers and an angle indicator configured to couple to the centerline marker at a first end and one of the one or more alignment angle markers at a second opposite end, wherein the angle indicator indicates a preselected club angle for a user. The centerline marker, the one or more alignment angle markers and the angle indicator can comprise one or more stickable decals.

14 Claims, 9 Drawing Sheets

(56) References Cited

U.S. PATENT DOCUMENTS

| | | | | |
|---|---|---|---|---|
| 2006/0079342 | A1* | 4/2006 | Koiwai | A63B 71/0622 473/219 |
| 2007/0123364 | A1* | 5/2007 | Solari | A63B 60/10 473/409 |
| 2009/0270194 | A1* | 10/2009 | Casati, Jr. | A63B 60/10 473/201 |
| 2009/0312113 | A1* | 12/2009 | Brooks | A63B 69/3632 473/231 |
| 2010/0261542 | A1* | 10/2010 | Maglaque | A63B 69/3617 473/300 |
| 2011/0081982 | A1* | 4/2011 | John | A63B 53/0466 473/257 |
| 2012/0010012 | A1* | 1/2012 | Piepho | A63B 53/0487 473/409 |
| 2019/0314701 | A1* | 10/2019 | Schmedes, III | A63B 71/0622 |
| 2021/0339090 | A1* | 11/2021 | McLachlin | A63B 69/3632 |

* cited by examiner

ALIGNMENT AID ON GOLF GRIP OR GOLF SHAFT

CROSS-REFERENCE TO RELATED APPLICATIONS

This application claims the benefit of U.S. Provisional Application No. 63/205,623, filed on Dec. 30, 2020. The entire disclosure of the above application is incorporated herein by reference.

FIELD

The present technology relates to golf and, more particularly, to an alignment aid for a golf club.

INTRODUCTION

This section provides background information related to the present disclosure which is not necessarily prior art.

A key to a good golf score is the ability to predict a trajectory and a result of a golf shot. Such consistency is desired by amateur players and professionals alike. However, even a small change in a golf swing can alter a flight path of the golf ball and cause the golf ball to miss its intended target.

Without a proper alignment of the golf club, it is difficult for a golfer to build consistency within their golf game. If, for example, the club face of the golf club is not properly aligned and is a degree open or closed based on the intended target line at impact, this can cause a miss of 10-15 yards or more (depending on club head speed).

The position of the golf club shaft and club face at address influences the flight path of the golf ball. For example, a zero-shaft lean, where the club shaft is positioned orthogonal to a club impact surface, is a sub-optimal condition to strike the golf ball for maximum distance and accuracy. A forward press or positive shaft lean, where the golf club shaft is leaned toward the target, forces a downward hit on the ball, compresses the ball and achieves a better ball strike and a purer flight path.

Currently, however, there is no single tool or golf aid that coaches a user to align a club face consistently and accurately. Consequently, the proper angle of the club head cannot be reproduced, which leads to inconsistent golf swings and inconsistent golf shots.

There is a need for a golf aid that creates a consistent and reproducible alignment of the golf club and the golf club face to create a reproducible ball strike.

SUMMARY

In concordance with the instant disclosure, an alignment aid for a golf club that creates a consistent and reproducible alignment of the golf club face and a consistent and reproducible ball strike, has surprisingly been discovered. The present technology includes articles of manufacture, systems, and processes that relate to an alignment aid for a golf club. Ways of making and using the alignment aid are also provided.

In a first embodiment, an alignment aid for a golf club includes a centerline marker for marking a centerline of a shaft of a golf club, one or more alignment angle markers, and an angle indicator configured to couple to the centerline marker at a first end and one of the one or more alignment angle markers at a second opposite end, wherein the angle indicator indicates a preselected club angle for a user. In some embodiments, the centerline marker, the one or more alignment angle markers, and the angle indicator comprise one or more stickable decals.

The centerline marker, the one or more alignment angle markers and the angle indicator can be attached to the golf club by an end user. In some embodiments, the centerline marker, the one or more alignment angle markers, and the angle indicator are permanently affixed to the golf club. In some embodiments, the one or more alignment angle markers are one of printed on, pressed into, and a decal that is fitted into a recess of a grip of the golf club. The alignment aid can further comprise a club face indicator for indicating whether a face of the golf club is in an open position or a closed position. In some embodiments, the centerline marker further comprises one or more distance indicators, wherein the one or more distance indicators enable the user to judge a distance of the golf ball from an object.

In another embodiment, a golf club alignment system comprises the golf club comprising a golf club grip, a golf club shaft, and a golf club head. The golf club alignment system further comprises a centerline marker disposed on the golf club shaft, wherein the centerline marker indicates a centerline of the golf club shaft, one or more alignment angle markers disposed on the golf club, and an angle indicator configured to couple to the centerline marker at a first end and one of the one or more alignment angle markers at a second opposite end, wherein the angle indicator indicates a preselected club angle for a user. In some embodiments, the centerline marker, the one or more alignment angle markers and the angle indicator comprise one or more stickable decals. The centerline marker, the one or more alignment angle markers and the angle indicator can be attached to the golf club by an end user. In some embodiments, the centerline marker, the one or more alignment angle markers and the angle indicator are permanently affixed to the golf club. In some embodiments, the one or more alignment angle markers are one of printed on, pressed into, and a decal that is fitted into a recess of a grip of the golf club. In some embodiments, the alignment system further comprises a club face indicator for indicating whether a face of the golf club is in an open position or a closed position. The golf club can comprise one of a driver, a wood, a hybrid club, an iron, a wedge, and a putter, and other appropriately desired clubs as needed.

In a further embodiment, a method of aligning a golf club to a preselected shot angle when hitting a golf ball from a surface comprises choosing a shot angle, placing a shot angle indicator onto a golf club, wherein the shot angle indicator points to an alignment angle marker disposed on the golf club, and which indicates a preselected shot angle, addressing the golf ball, and tilting the golf club shaft in a direction toward a target until the preselected shot angle indicator is orthogonal to the surface. In some embodiments, tilting the club shaft toward to the target changes a loft angle of the golf club. The alignment angle marker and the angle indicator can be attached to the golf club by an end user. In some embodiments, the alignment angle marker is disposed on the golf club during manufacture of the golf club. The alignment angle marker can be printed on and/or pressed into a grip of the golf club. The golf club can comprise one of a driver, a wood, a hybrid club, an iron, a wedge, and a putter, and other appropriately desired clubs as needed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 shows an alignment aid for a golf club, in accordance with the present technology;

FIGS. 2A-2C each show portions of an alignment aid for a golf club, in accordance with the present technology;

Figure 8:
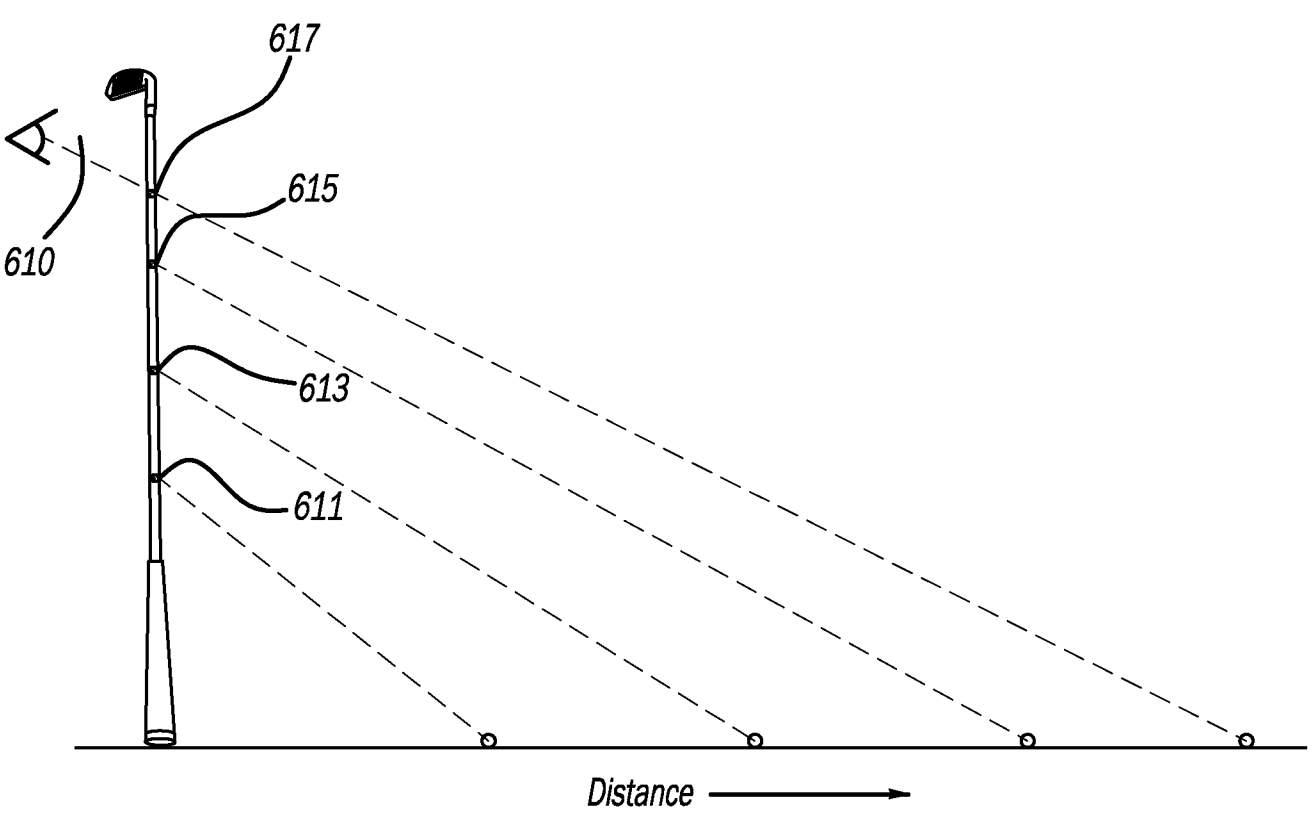
Figure 7:
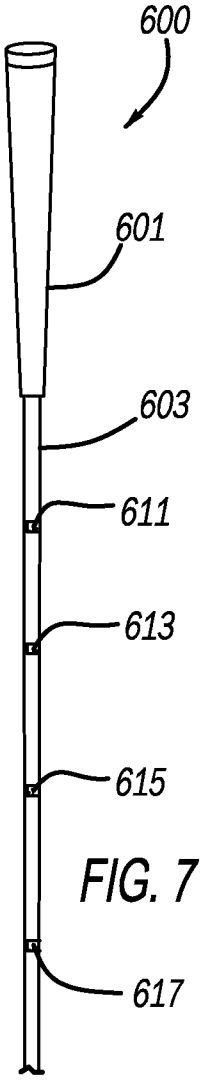
Figure 9:
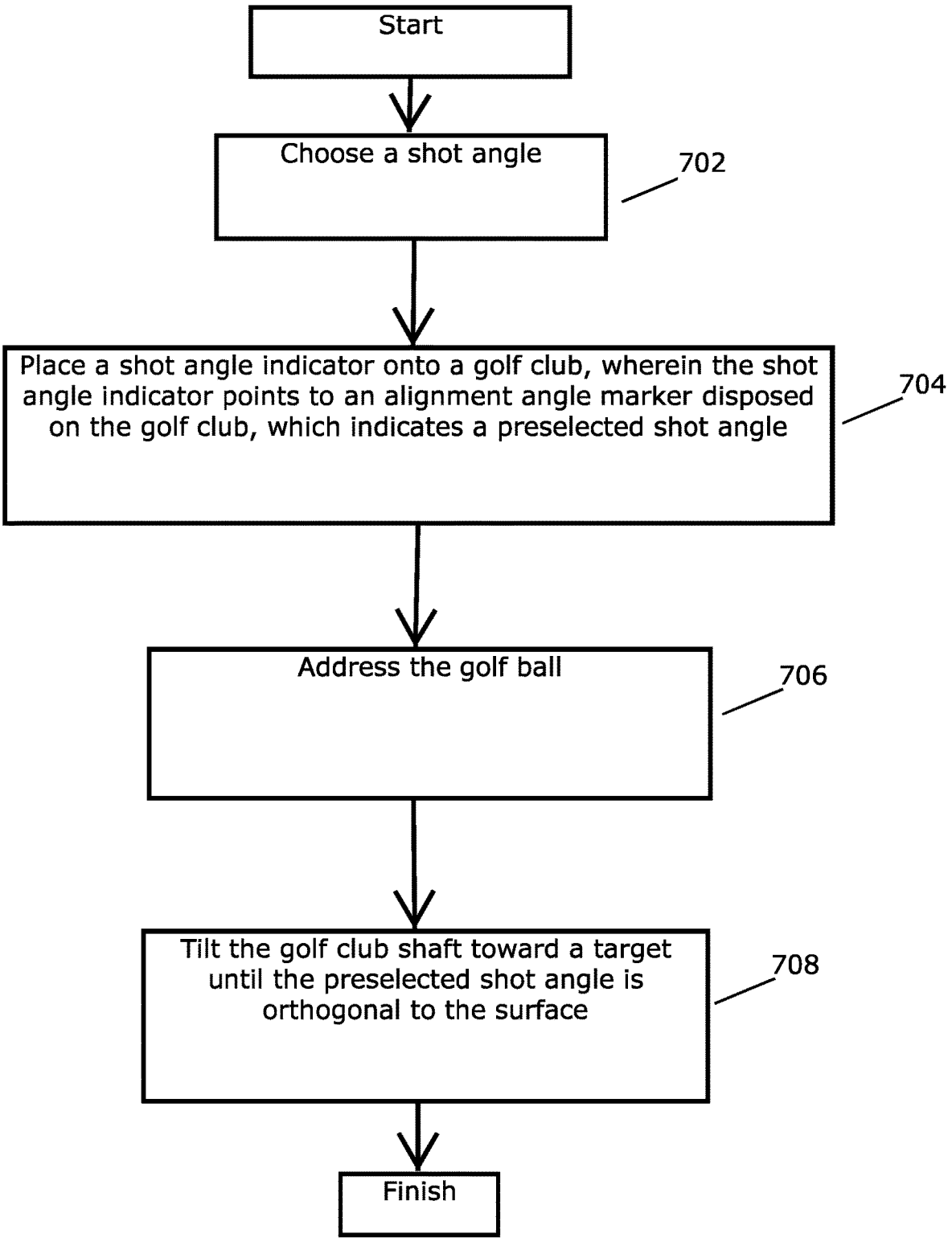

FIGS. 7 and 8 each show an alignment aid comprising one or more distance markers, in accordance with the present technology; and FIG. 9 shows a method of aligning a golf club to a preselected shot angle, in accordance with the present technology.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology includes an alignment aid for a golf club that enables a consistent and reproducible alignment of the golf club face and a consistent and reproducible ball strike. An alignment aid for a golf club can be on the grip of a golf club or on the shaft itself. The alignment aid can allow a user to tilt, turn, or move in the desired direction to allow the user to look at a line or dots for an angle reference. Examples include, but are not limited to, a forward press angle and a closed face club loft angle, or other needed or preselected angles for the user. In particular, a different degree of forward shaft lean can affect the angle of impact on the ball giving it the desired backspin, height distance and ball roll on the green.

Ways of making and using the alignment aid can include the following aspects. The alignment aid can be used as a training tool or used as an alignment aid when playing. This alignment aid can be used as a tool when having a golf club fitted for a user's needs. This alignment aid is used to help the user place the club in a desired position to have the best possible alignment when hitting the ball. The alignment aid can be printed onto or recessed into the grip with as many angles as desired. Colored lines or color shaded areas can be used to show the alignment angles. In some embodiments, the alignment aid can comprise a decal that is fitted into a recess of a grip of the golf club. The alignment aid can be placed on the shaft below the grip to allow the user to look down at the aid to see the angles of alignment on a decal or printer/raised artwork on the shaft. The alignment aid can be a one piece or multiple pieces going down the shaft to show a straight line down the shaft for a center of alignment angle. A line or colored artwork can be used at the end of the shaft to view the open or closed face position of the club head. Again, the alignment aid can be attached to or printed on the shaft in many different ways and with different types of material on the market, and with different colors within the artwork. The alignment aid is used to help the user look down at the aid and move the club at a desired angle according to the lines or artwork provided for the user's needs.

In some embodiments, a main decal and/or alignment aid comprising a plurality of alignment angle markings is placed below a grip. A decal and/or alignment aid is placed in a center of a club shaft, going down the full length of the shaft. A small decal and/or alignment aid is placed at a bottom end of the center decal near the club head. This decal can be used to see open and closed face angles of the head of the club and can be any color or shape. A small decal and/or alignment aid with a center line can be placed on the main decal placed below the top alignment aid and is angled to cover the desired angle, with just the center line being viewed for alignment needs. If desired, this small decal can be left off and the alignment aid with the plurality of alignment angle markings can be used to position the club shaft as needed.

In other embodiments, one or more small hash marks on the side of the alignment aid running the length of the shaft are user to held judge a distance to a ball on the green or distance to other objects as needed. This can be done by placing the end of the golf grip on the ground with the head of the club pointed upwards. In this configuration, the user can use the one or more hashmarks as marker to judge the distance to the ball. By kneeling down and/or lining up the ball or target with one of the one or more hashmarks, a user is able calculate a reasonable distance to an intended target. For example, the closer a user is to a ball the lower the hash mark on the shaft would be. The alignment aid allows a user to flip a club upside down and place the grip end on the ground and use the line of sight to look at the ball and based on which hash mark lines up with the ball while the user is kneeling and/or eye level with the correct hash mark helps the user quickly and better judge the distance to the hole. In some embodiments, the alignment aid comprises 2 different sets of marks. The first set of marks can judge a distance the ball distance and the other can be used to judge flag distance. In some embodiments, the two sets of marks comprise different colors. However, the two marks can be differentiated in any appropriately desired manner.

In yet further embodiments, the alignment aid is not placed on a shaft of the golf club. In these further embodiments, the angles of alignment can be printed on and/or recessed into the golf club grip. In this manner, a grip can be placed on a golf shaft with the alignment aid already on it. The alignment aid can be any color and/or artwork as appropriately desired. In some embodiments, the alignment aid can comprise a decal that is fitted into a recess of a grip of the golf club. The golf cub grip can be tilted left or right such that a right-handed user and a left-handed user is able to look down the line to find their desired angle of choice.

In use, the alignment aid when placed on a grip, attached, or printed on the shaft and/or the golf club grip, can allow a user to tilt or angle the shaft to the desired angle for a forward press or other desired angle. Particularly, the alignment aid allows a user to place the grip of the club slightly left or right of center of the head of the club for left- or right-handed players appropriately. Additionally, the alignment aid can allow a left-handed or a right-handed user to have a consistent shaft lean when needed or the center line down the shaft can show a neutral loft and/or club angle position. The different degrees of forward shaft lean affect the angle of impact on the ball to give the ball the desired backspin, height, distance and ball roll on the green. The alignment aid can be used on all clubs to give the user the preferred head club position at impact of the ball.

EXAMPLES

Example embodiments of the present technology are provided with reference to the several figures enclosed herewith.

Figure 1:
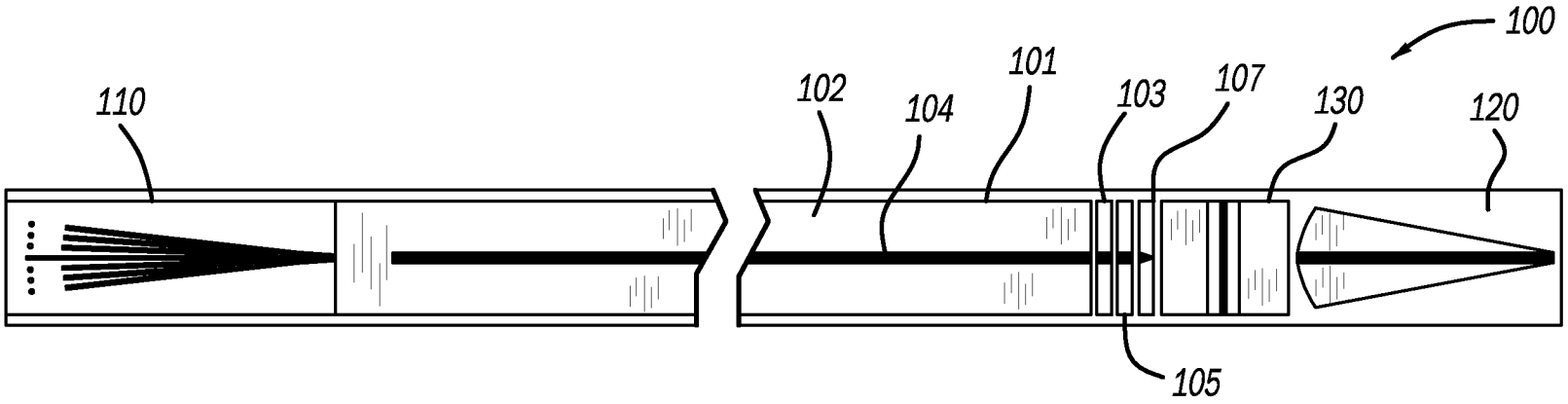

Referring to FIG. 1, an alignment aid 100 for a golf club (200, shown in FIG. 3D) is shown therein. The alignment aid 100 comprises a centerline marker 101, a golf club alignment angle marker 110, and an angle indicator 120. As shown within FIG. 1, in some embodiments the alignment aid 100 comprises a club face indicator 130 and one or more alignment reference strips 103, 105, and 107. In some embodiments, the centerline marker 101, the golf club alignment angle marker 110, and the angle indicator 120 each comprise a stickable decal that can be stuck on a shaft (203, shown in FIG. 3A) of the golf club 200. Alternatively, the golf club alignment angle marker 110, and the angle indicator 120 are pre-printed and/or etched on the golf club shaft 203 or a grip (201, shown in FIG. 3A) of the golf club 200.

In some embodiments, the centerline marker 101 comprises a centerline marker body 102 and a centerline marking 104. The centerline marker 101 is coupled to and/or otherwise disposed on the shaft 203 of the golf club 200 and is configured to indicate the centerline of the golf club shaft 203. In some embodiments, the centerline marker 101 is configured to run the entire length of a golf club shaft 203. Alternatively, in some embodiments, the centerline marker 101 runs only partially down a length of the golf club shaft 203. Particularly, the centerline marker 101 can be any appropriately desired length for indicating a centerline of the golf club shaft 203. As shown in FIG. 1, in some embodiments, one or more alignment reference strips 103, 105, and 107 can be used to mark a center of the golf club shaft 203 when attaching the centerline marker 101.

In some embodiments, such as described further below, the angle indicator 120 is placed on a top of the golf club alignment angle marker 110 in a desired configuration to indicate a desired golf club alignment. Particularly, the angle indicator 120 can be placed on a top of the golf club alignment marker 110 such that an alignment line 122 of the angle indicator 120 points to an alignment mark (FIG. 2A) of the golf club alignment angle marker 110.

The golf club alignment aid 100 can comprise one or more pieces as appropriately desired. For example, in some embodiments, the golf club alignment aid 100 comprises two or three pieces that can be separately attached to the golf club. Alternatively, in some embodiments, the golf club alignment aid 100 is preprinted and/or etched onto the golf club shaft 203 or the golf club grip 201. In some embodiments, the alignment aid 100 can be used on one of a driver, a wood, a hybrid club, an iron, a wedge, and a putter. Particularly, the alignment aid 100 can be used on any appropriately desired golf club for practice and/or for use while playing a round of golf.

Figure 2A:
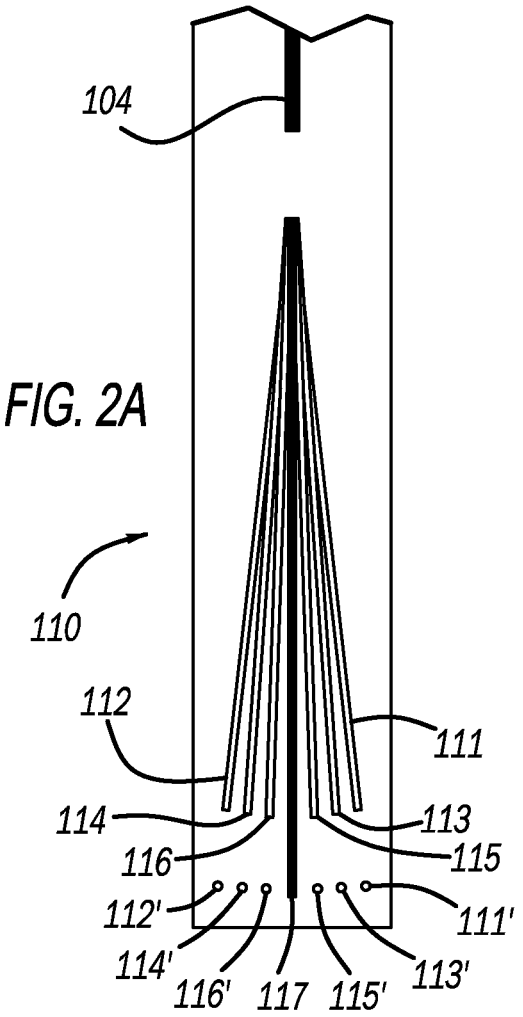

FIG. 2A shows an alignment angle marker 110, such as described above, in accordance with some embodiments. FIG. 2A shows the alignment angle marker 110 as it would be seen looking down a length of the golf club shaft 203, with the alignment angle marker 110 disposed on and/or coupled on the golf club shaft 203. The alignment angle marker 110 comprises one or more alignment angle lines and alignment angle marks that indicate a preselected club angle. For example, as shown within FIG. 2A, the alignment angle marker 110 comprises one or more alignment angle lines 112, 114, and 116, and alignment angle marks 112', 114', and 116' that indicate change of a loft angle and/or club angle of the golf club face and a golf club shaft lean toward a target for a left handed user. As further shown within FIG. 2A, the alignment angle marker 110 comprises one or more alignment angle lines 111, 113, and 115 and alignment angle marks 111', 113', and 115' that indicate a golf club lean toward the target and a change the loft angle of the golf club face for a right handed user. In some embodiments, a center point 117 of the alignment angle marker 110 indicates a neutral loft position or a neutral address of the golf ball where the center point 117 is aligned within the centerline of the golf club, such as described above. In some embodiments, the alignment angle lines and the alignment angle marks, such as described above are offset 2° from the center point 117 in increasing intervals. For example, the alignment angle mark 115' shows a +2° offset, the alignment angle mark 113' shows a +4° offset and the alignment mark 111' shows a +6° degree offset from the neutral position for the right handed user. Similarly, the alignment angle mark 116' can show a +2° offset, the alignment angle mark 114' shows a +4° offset, and the alignment angle mark 112' can show a +6° offset from the neutral position for a left handed user. However, as will be apparent to someone of ordinary skill in the art, the alignment angle marks can show an offset at any appropriately desired angles. The alignment angle marker 110 can indicate an appropriately desired number of offset angles.

As described above, in some embodiments, the alignment marker 110 comprises a stickable decal which is attached to the golf club 200. However, the alignment angle marker 110 can be pre-printed, etched, and/or attached to the golf club 200 during manufacture of the golf club 200, if desired. Particularly, the alignment angle marker 110 can be disposed on the golf club in any appropriately desired manner.

Figure 2B:
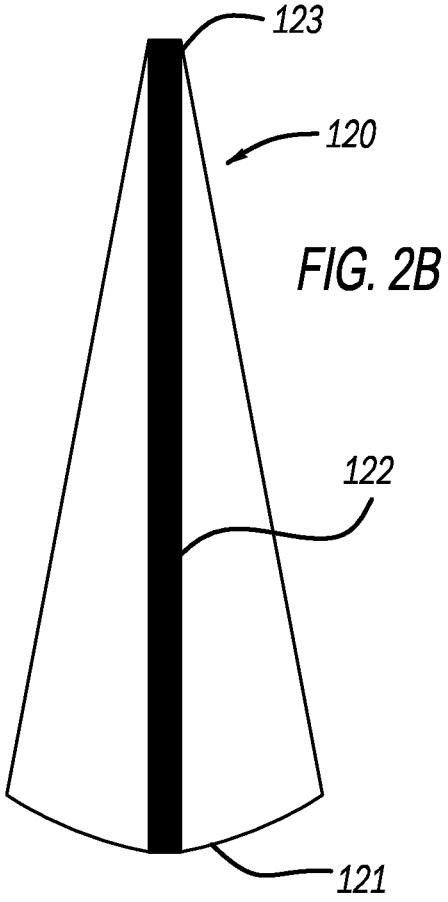

FIG. 2B shows an angle indicator 120 for an alignment aid 100, such as described above. The angle indicator 120 is configured to indicate a desired club alignment angle when used in combination with the alignment angle marker 110 and the centerline marker 101, such as described above. Particularly, the alignment line 122 of the angle indicator 120 can point to an alignment angle mark of the alignment marker to indicate a desired alignment angle of the golf club 200. For example, in some embodiments, the angle indicator 120 is placed over the alignment angle marker 110 such that the alignment line 122 points to the alignment angle mark 116', which indicates a +2° offset from the neutral position.

As shown within FIG. 2B, the angle indicator 120 comprises a first end 123, a second end 121, and the alignment line 122 that passes through a center of the angle indicator 120. The angle indicator 120 is placed on a golf club such that the alignment line 122 points to the centerline marker 101 at a first end and an alignment angle mark (FIG. 2A) at a second opposite end. For example, in some embodiments, the alignment line 122 points to the centerline marking 104 at the first end 123 and an alignment angle mark at the second end 121. As shown within FIG. 2B, in some embodiments the angle indicator 120 comprises a triangle-like shape with a rounded second end 121. In these embodiments, when the angle indicator 120 is placed on the alignment angle marker 110, the second end 121 is configured to cover those alignment marks which are not pointed to by the alignment line 122. Consequently, the user only sees the desired offset angle of the golf club 200. As would be understood by someone of ordinary skill in the art, the angle indicator 120 can comprise any appropriately desired shape for indicating the desired angle of the golf club 200.

As described above, in some embodiments the angle indicator 120 comprises a stickable decal which can be placed onto the alignment angle marker 110. In some embodiments, the angle indicator 120 is permanently affixed onto the alignment angle marker 110 such that the angle indicator 120 indicates the same club alignment with each shot using the golf club 200. It should be appreciated that the permanent affixing may be desired for reasons of certain professional golfing rules and standards. Alternatively, the angle indicator 120 can be removably coupled with the alignment angle marker 110. In these embodiments, the angle indicator 120 is coupled to the alignment angle marker 110 and can be removed and rotated such as when a user wishes to hit a golf shot with the golf club 200 aligned at a different angle. In alternate embodiments, the angle indicator 120 couples with the alignment angle marker 110 using a hook and loop fastening system, magnetic connection, snap fastener or other appropriately desired removable fastening system.

Figure 2C:
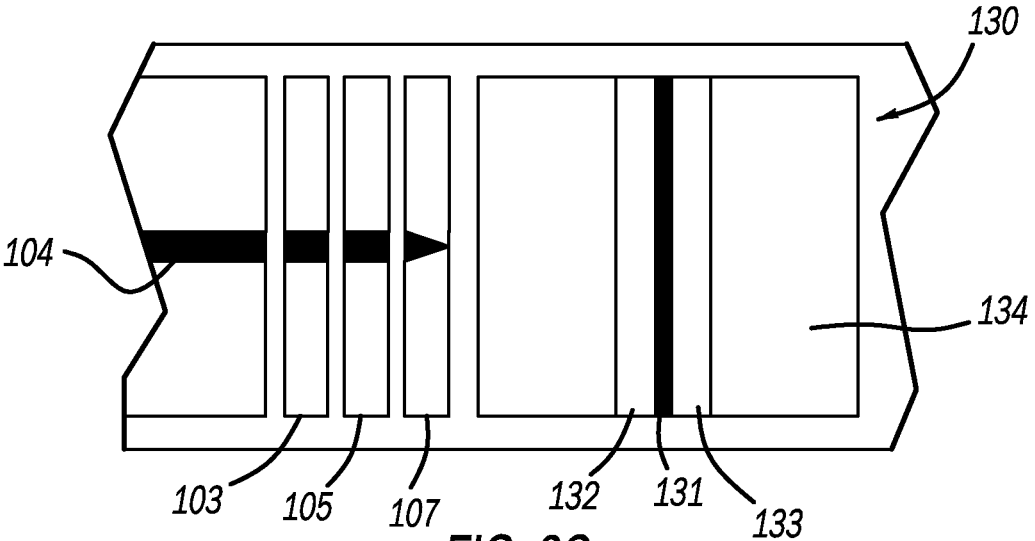

As shown within FIG. 2C, in some embodiments, the alignment aid comprises a golf club face indicator 130. The golf club face indicator 130 visually indicates whether the club face is in a neutral position, an open position, and a closed position. For example, the club face indicator centerline 131 continues the centerline marking 104, such as described above. The golf club face indicator 130 comprises a first club face indicator 132 and a second club face indicator 133, for indicating a rotation to an opening of the club face and a rotation to a closing of the club face, respectively. Alternatively, in some embodiments, the first club face indicator 132 indicates a closing of the club face and the second club face indicator 133 indicates an opening of the club face. In some embodiments, the first club face indicator 132 and the second club face indicator comprise a colored and/or a white decal. However, the first club face indicator 132 and the second club face indicator can comprise any appropriate color, design, and/or other marking to indicate an opening and a closing of the club face. In some embodiments, the club face indicator 130 is wrapped around the base of the golf club shaft 203 near the golf club head so that the club face centerline 131 continues the centerline marking 104.

With the golf club face indicator 130 disposed on, or otherwise coupled to the golf club shaft 203, the club 200 can be rotated to the right or left. When the golf club 200 is at a neutral alignment, the user will only see the club face indicator centerline 131 as the user looks down the golf club shaft 203. As the golf club is rotated to the left and the right, the user will see more of the first club face indicator 132 and the second club face indicator 133, indicating the club face is open or closed.

In some embodiments, the golf club face indicator 130 is used with the alignment aid 100, such as described above. Alternatively, the golf club face indicator 130 can be used on its own, without the alignment aid 100. The club face indicator 130 can be wrapped around the base of the golf club shaft 203 near the golf club head (205, shown in FIG. 3C) so that the club face centerline 131 marks a centerline of the golf club shaft 203. Then, as the golf club 200 is rotated to the left and the right, the user will see more of the first club face indicator 132 and the second club face indicator 133, indicating the club face is open or closed. Particularly, the golf club face indicator 130 can comprises any appropriately desired configuration and/or orientation for indicating whether a club face is open/closed and/or neutral and can be used in conjunction with the alignment aid 100 or as a stand-alone product.

As further shown within FIG. 2C, the alignment aid 100 comprises one or more alignment reference strips 103, 105, and 107. The one or more alignment reference strips 103, 105, and 107 are used to mark a top center of a golf club grip 201 where the shaft 203 starts and a bottom center of the golf club shaft 203 where the golf club head 205 is connected. In some embodiments, the one or more alignment reference strips 103, 105, and 107 comprise a small line decal, such as a small red or other colored line to mark the top center and the bottom center of the golf club shaft 203.

With an alignment reference strip 103, 105, and 107 attached to a top center of the grip 201 where the shaft 203 starts and a bottom center of the golf club shaft 203 where the golf club head 205 is connected, the centerline marker 101 can be coupled to the golf club shaft 203. To couple the centerline marker 101 with the golf club shaft, the centerline marking 104 is aligned with the reference strip at a top center of the golf club grip 201 and the reference strip at the bottom center of the golf club shaft 203 so that the centerline marking 104 indicates the centerline of the golf club shaft 203. When the centerline marker 101 is properly aligned it can be pressed onto the golf club shaft 203 to couple to the golf club shaft 203. The one or more alignment reference strips 103, 105, and 107 ensure that the centerline marker 101 is centered on the golf club shaft 203 and is properly aligned. In some embodiments, the centerline marker 101 is trimmed before it is placed onto the golf club shaft 203.

In some embodiments, after the centerline marker 101 is placed onto the golf club shaft 203, the reference strips can be removed. Additionally, it is contemplated that the centerline marker 101 can be adjusted to ensure that it is properly straight as it is placed on the golf club shaft 203. Additionally, although three alignment reference strips 103, 105, and 107 are shown within FIG. 2C, as would be understood by someone of ordinary skill in the art any appropriately desired number and/or configuration of reference strips 103, 105, and 107 can be used to place the centerline marker 101 onto a shaft of the golf club.

As described above, the alignment aid 100 can comprise one or more pieces as appropriately desired. For example, in some embodiments, the centerline marker 101, the golf club alignment angle marker 110, and the angle indicator 120 each comprise discrete decals which can be attached to the golf club 200. Each of the discrete decals may be provided on a single backing strip, however, as part of a kit for use in installing the alignment aid 100 on the golf club 200. Alternatively, in some embodiments, the centerline marker 101 and the alignment angle marker 110 are a single decal which is attached to the golf club and the angle indicator 120 is a discrete decal which is placed on the alignment angle marker 110, such as described above and shown in FIG. 1.

Figure 3A:
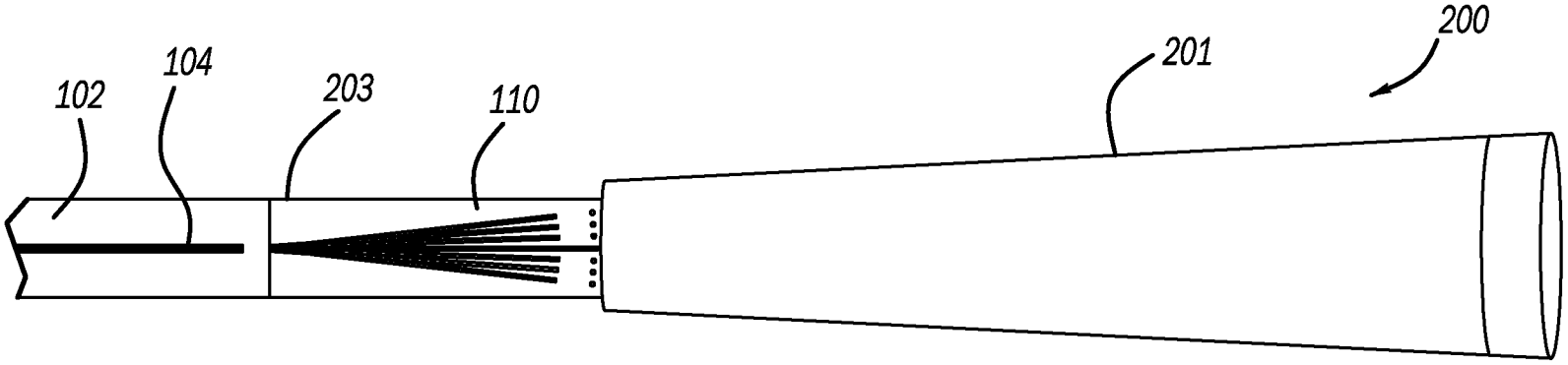
FIGS. 3A-3E show portions of an alignment aid for a golf club, in accordance with the present technology.

FIG. 3A shows a view of the alignment angle marker 110 disposed on and/or coupled to the golf club 200. As shown within FIG. 3A, the golf club 200 comprises a golf club grip 201, the golf club shaft 203, and a golf club head 205. The alignment angle marker 110 is shown on the golf club 200 such that the alignment angle marker 110 abuts or is otherwise disposed adjacent a bottom of the golf club grip 201. The body 102 of the centerline marker 101 has been placed on the shaft 203 of the golf club 200 so that the centerline marking 104 marks the middle of the golf club shaft 203. As described above, in some embodiments, the centerline marker 101 runs a length of the golf club shaft 203 from next to the golf club grip 201 to next to the golf club head 205.

Figure 3B:
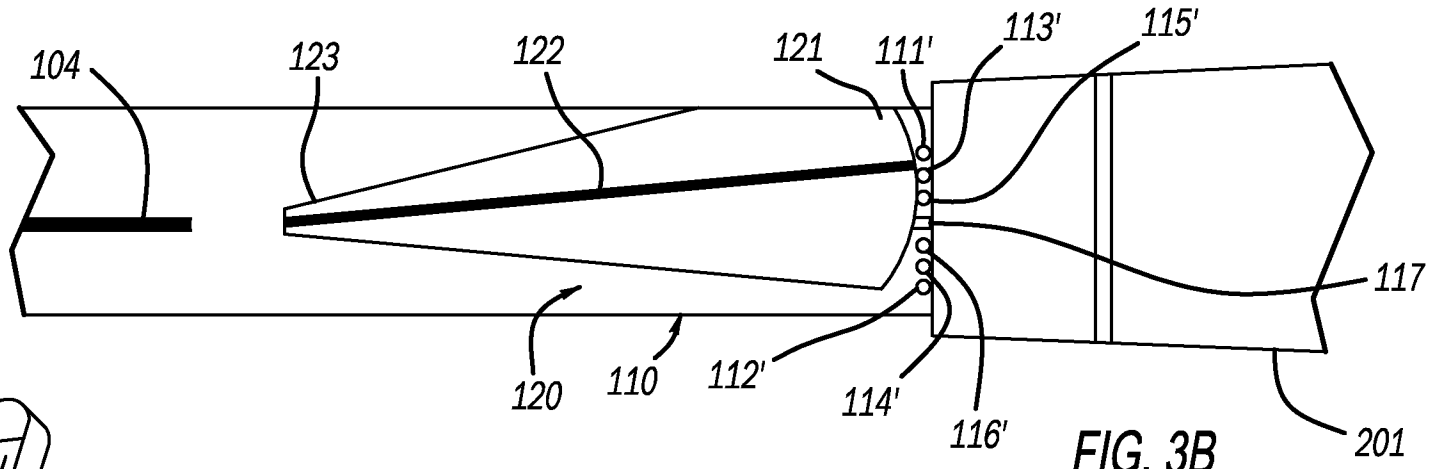

FIG. 3B shows the angle indicator 120 disposed onto and/or affixed over the alignment angle marker 110, in accordance with some embodiments. As shown within FIG. 3B, the angle indicator 120 is placed on the golf club 200 such that the alignment line 122 points to the centerline marker 101 at a first end 123 and an alignment angle mark at a second opposite end 121. In some embodiments, the alignment angle marker 110 comprises one or more alignment angle marks 112', 114', and 116' for indicating a golf club shaft 203 lean for a left handed user and one or more alignment angle marks 111', 113', and 115' for indicating a golf club shaft 203 lean for a right handed golfer. The center point 117 of the alignment angle marker 110 indicates a neutral position or a neutral address of the golf ball where the center point is aligned within the centerline of the golf club, such as described above.

Figure 3C:
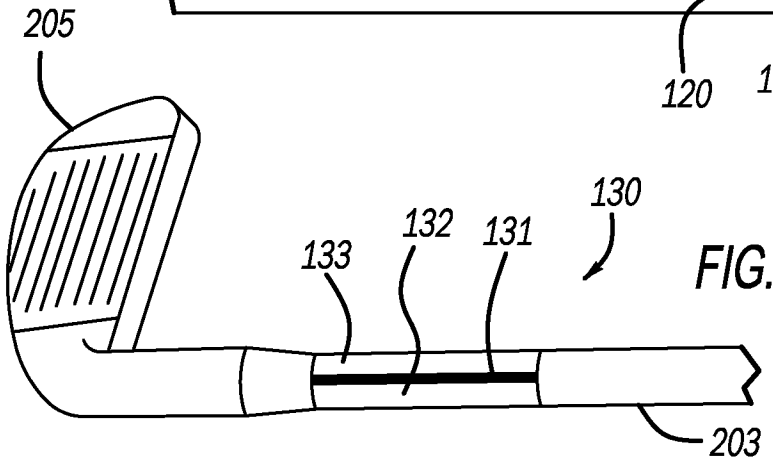

FIG. 3C shows the club face indicator 130 disposed on, or coupled to a bottom of club shaft 203, near the golf club head 205. As described above, the club face indicator 130 can provide a visual indication of whether the club face is in a neutral position, an open position, and a closed position. In some embodiments, the club face indicator 130 comprises a club face indicator centerline 131, a first club face indicator 132 and a second club face indicator 133. As described above, the club face indicator 130 can be disposed on and/or coupled to the golf club at a bottom of the golf club shaft 203 next to the golf club head 205, such as described above. With the club face indicator 130 coupled to the golf club 200, the user can quickly visually monitor whether the club face is open or closed based on whether the user sees more of the second club face indicator 133 or the first club face indicator 132, when the user is addressing the golf ball before hitting a golf shot.

Figure 3D:
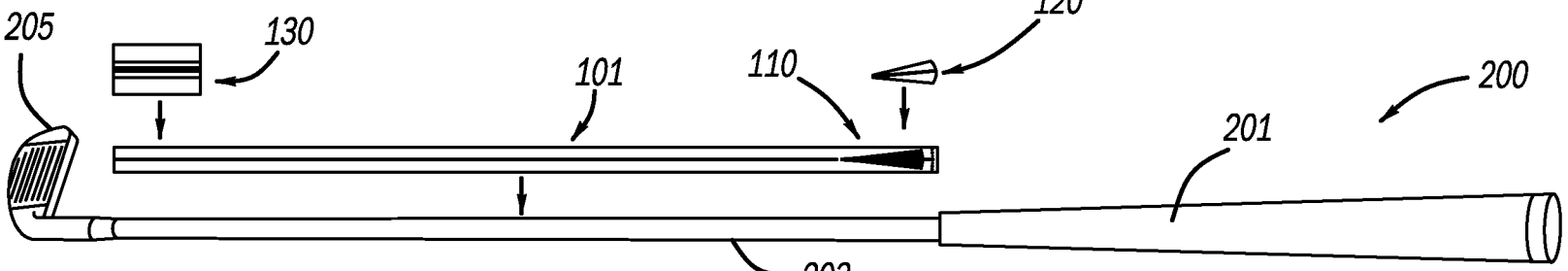
Figure 3E:
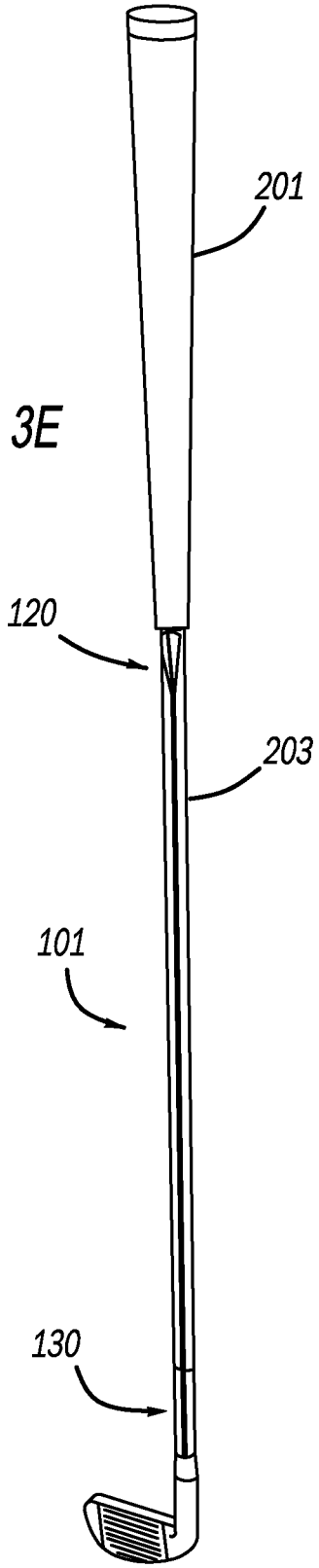

FIG. 3D shows the alignment aid 100 before it has been disposed on and/or coupled to a golf club 200. As shown within FIG. 3D, the golf club 200 comprises a golf club grip 201, a golf club shaft 203, and golf club head 205. As described above, in some embodiments, a centerline marker 101, a golf club alignment angle marker 110, and an angle indicator 120 comprise decals which are attached to the golf club 200. FIG. 3E shows the alignment aid 100 coupled to the golf club 200. As described above, in some embodiments, the golf club alignment aid 100 comprises two or three pieces that can be separately attached to the golf club 200. Alternatively, in some embodiments, the golf club alignment aid 100 is preprinted and/or etched onto the golf club shaft 203 or golf club grip 201, such as described above. The alignment aid 100 such as shown within FIG. 3D can be used on one of a driver, an iron, a wedge, and a putter. Particularly, the alignment aid 100 can be used on any appropriately desired golf club 200 for practice and/or for use while playing a round of golf.

With the alignment aid 100, such as described above, a user addresses the golf ball before hitting a golf shot. The user can then tilt the golf club 200 toward a target to change the loft angle of the club face. The user tilts the golf club 200 until the alignment line 122 of the angle indicator 120 is orthogonal to the ground. When the golf club 200 is properly tilted, the user can look down a length of the alignment line 122, and straight down toward the ground. In this position, the golf club comprises a preselected loft angle and/or club angle (410, FIG. 6B; 410' FIG. 6D) as selected by the user. As described above, the alignment line 122 points to an alignment angle mark for indicating a positive golf club movement and a closing of the golf club face. Although, the present specification describes tilting a golf club shaft 203 toward a target to change the loft angle of the golf club 200 to hit a press shot, it is contemplated that the alignment aid can be used to change the loft angle of a golf club 200 to hit at any desired club angle, including neutral and open.

Figure 4A:
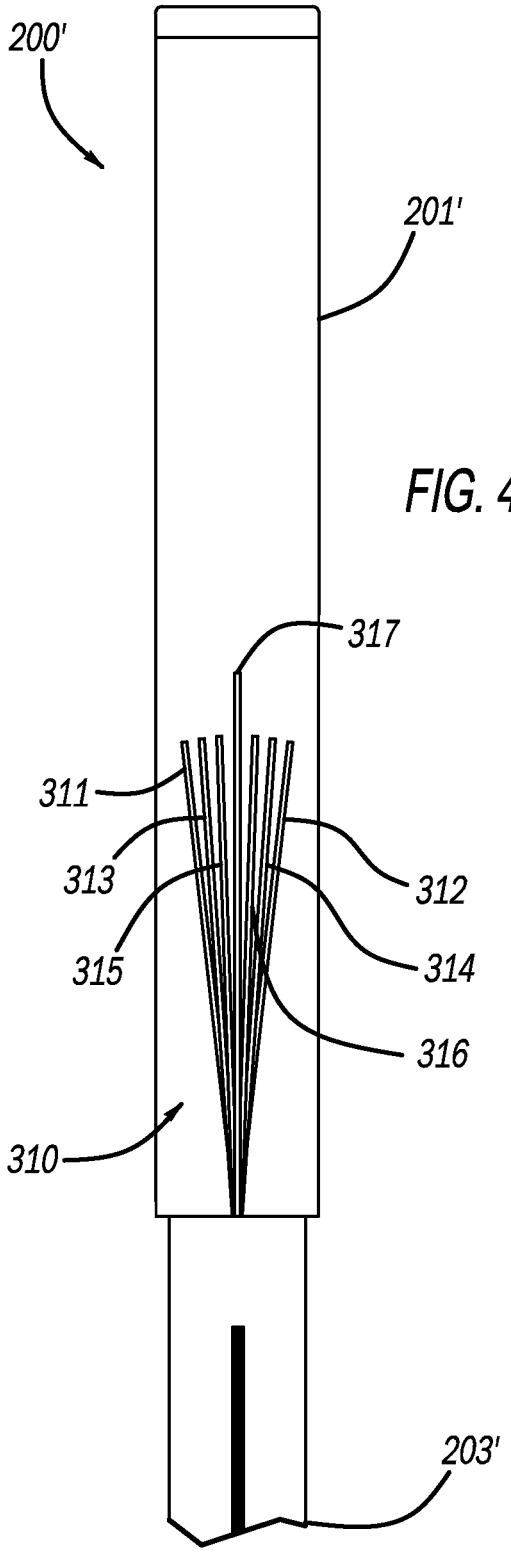
FIGS. 4A-4D show an alignment aid for a golf club, in accordance with the present technology.

As shown within FIG. 4A, in some embodiments, an alignment angle marker 310 comprises a component of a golf club grip 201'. The alignment angle marker 310 can be etched onto, printed onto, and otherwise placed on the grip 201'. In some embodiments, the alignment angle marker 310 comprises a component of a grip 201' for a golf club 200' when the grip 201' is purchased by the user. Alternatively, in some embodiments, the alignment angle marker 310 comprises a component of a grip 201' that is placed on the golf club after the golf club 200' is purchased.

The alignment angle marker 310 comprises one or more alignment angle lines 311, 312, 313, 314, 315, and 316 that indicate a preselected club angle 410, 410' when the alignment angle marker 310 is placed on or otherwise disposed on a golf club 200'. For example, as shown within FIG. 4, the alignment angle marker 310 comprises one or more alignment angle lines 312, 314, and 316 for indicating a club shaft 203' rotation or lean for a left handed user. The alignment angle marker 310 comprises one or more alignment angle lines 311, 313, and 315 that indicate a golf club shaft 203 rotation or lean for a right handed user. In some embodiment, a center point 317 of the alignment angle marker 310 indicates a neutral position or a neutral address of the golf ball where the center point 317 is aligned within the centerline marking 104 of the golf club 200', such as described above. In some embodiments, when the alignment angle marker 310 is etched onto, printed onto, and otherwise placed on the grip 201', a user can fill-in, color, or otherwise mark a desire alignment angle line to mark the preselected club angle 410, 410'.

Figure 4B:
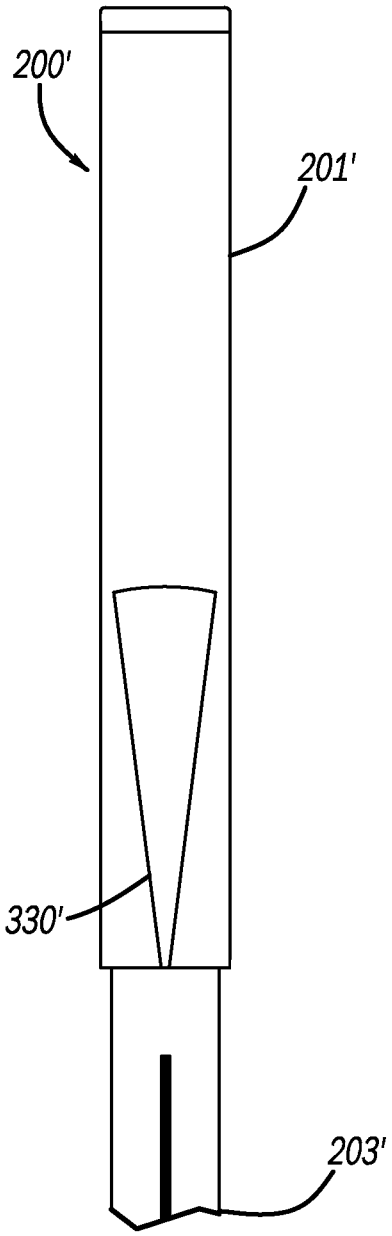
Figure 4C:
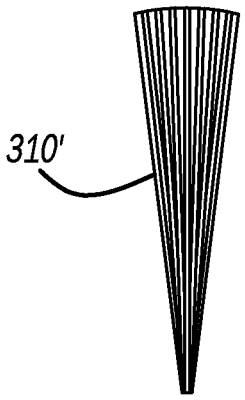
Figure 4D:
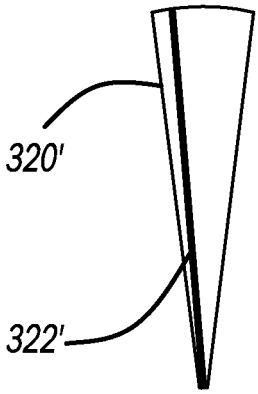

As further shown within FIG. 4B, in some embodiments, the golf club grip 200' comprises a recess 330'. The recess 330' can be imprinted into the golf club grip 200' during manufacture of the golf club grip 200'. In some embodiments, the recess 330' of the golf club grip 200' comprises a same shape as an alignment angle marker 310, such as described above. Accordingly, a decal comprising an alignment angle marker 310' can be pressed into the recess area 330'. In some embodiments, the alignment angle marker 310' comprises one or more alignment angle markings, such as described above. After the alignment angle marker 310' is press fit into the recess 330', an angle indicator 320' can be placed onto the alignment angle marker 310'. The angle indicator 320' can indicate a shot angle for the golf club 200'. In some embodiments, one or more angle indicators 320' which indicate a different shot angle can separately be placed over the alignment angle marker 310' and into the recess 330' of the grip 201'. Particularly, the angle indicator 320' can comprise a centerline 322' which points to a desired angle as indicated by the alignment angle marker 310' fit into the recess 330'. The angle indicator 320' can comprise any appropriately desired club angle for a user. In some embodiments, the recess 330', the alignment angle marker 310', and the one or more sized angle indicators 410' are sized so that the alignment angle marker 310', and the one or more sized angle indicators 410' are flush with an exterior of the grip 201' when placed in the recess 330'.

Figure 5A:
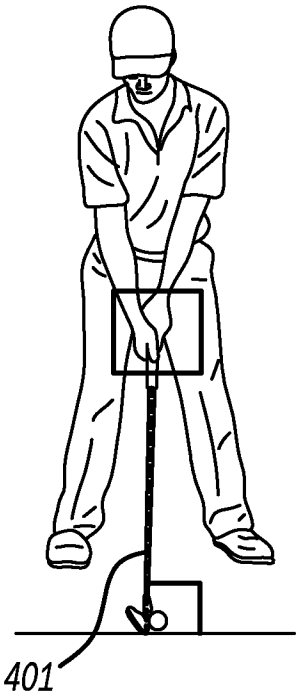
FIGS. 5A and 5B show a use of an alignment aid for a golf club for a right handed player, in accordance with the present technology.
Figure 5B:
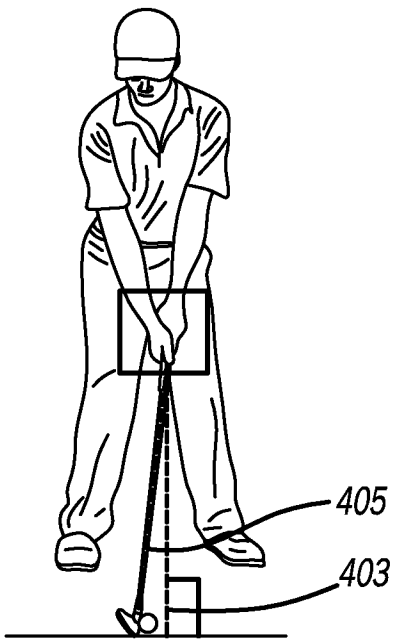

FIGS. 5A-5D show a use of the alignment aid 100 for a golf club, such as described above. FIGS. 5A and 5B show the use of the alignment aid 100 by a right handed user to hit a forward press shot, such as described above. With the alignment aid 100, such as described above, a user addresses the golf ball before hitting golf shot. As shown in FIG. 5A, looking down a length of the golf club 200, the golf club 200 is orthogonal to the ground as indicated by the centerline marker 401 where the centerline marker 401 is orthogonal to the ground. The user tilts the golf club 200 toward a target to change the loft angle of the club face. The user tilts the golf club until the alignment line of the angle indicator, as indicated by the line 403, is orthogonal to the ground with a shaft 203 of the golf club tilted 405 toward the target. In this position, the golf club comprises a closed loft angle. The alignment angle of the club comprises a preselected angle 410 as selected by the user with the angle indicator 120, such as described above. As shown in FIG. 5A, although the user is shown starting with the golf club 200 orthogonal to the ground, it should be appreciated that the club shaft may be placed forward and backward at address. Additionally, the starting position may require a different shaft lean as appropriately desired by the user.

Figure 5C:
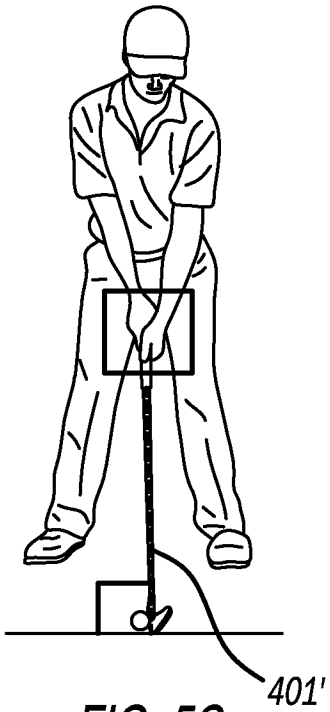
FIGS. 5C and 5D show a use of an alignment aid for a golf club for a left handed player, in accordance with the present technology.
Figure 5D:
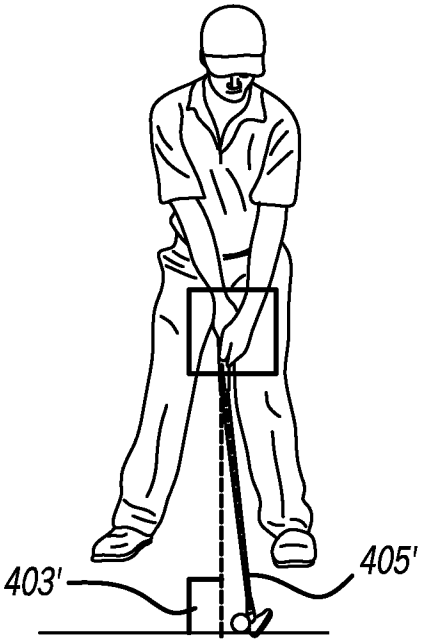

FIGS. 5C and 5D show the use of the alignment aid 100 by a left handed user, such as described above. With the alignment aid 100, such as described above, a user addresses the golf ball before hitting golf shot. As shown in FIG. 5C, looking down a length of the golf club 200, the golf club is orthogonal to the ground as indicated by the centerline marker 401' where the centerline marker 401' is orthogonal to the ground. The user tilts the golf club toward a target to change the loft angle of the club face. The user tilts the golf club 200 until the alignment line of the angle indicator, as indicated by the line 403', is orthogonal to the ground with a shaft 203 of the golf club tilted 405' toward the target. In this position, the golf club 200 comprises a closed loft angle. The alignment angle of the club 200 comprises a preselected angle 410' as selected by the user with the angle indicator 120, such as described above. As shown in FIG. 5C, although the user is shown starting with the golf club 200 orthogonal to the ground, it should be appreciated that the club shaft may be placed forward and backward at address. Additionally, the starting position may require a different shaft lean as appropriately desired by the user.

Figure 6B:
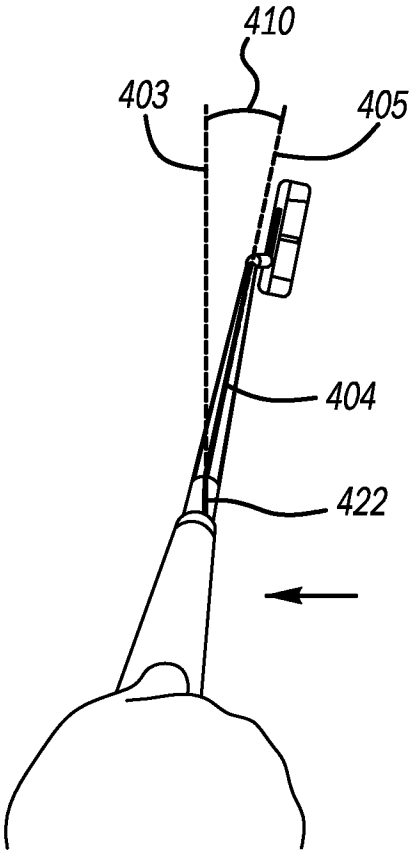
FIGS. 6A and 6B show a use of an alignment aid for a golf club for a right handed player, in accordance with the present technology.
Figure 6A:
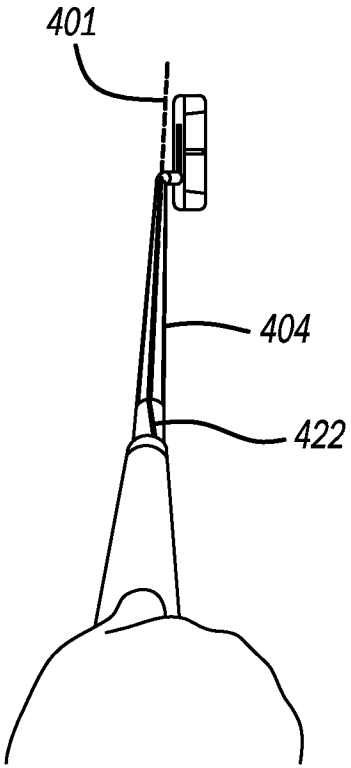

FIGS. 6A and 6B show a use of the alignment aid 100 for a golf club as viewed by a right handed user, to hit a closed face or press shot, such as described above. With the alignment aid 100, such as described above, a user addresses the golf ball before hitting golf shot. As shown in FIG. 6A, looking down a length of the golf club 200, the golf club 200 is orthogonal to the ground as indicated by the centerline marker 401 where the centerline marker 401 is orthogonal to the ground. As indicated by the arrow and in FIG. 6B, the user tilts the golf club toward a target to change the loft angle of the club face. The user tilts the golf club until the alignment line 422 of the angle indicator 120, as indicated by the line 403, is orthogonal to the ground. In this position, the golf club 200 comprises a closed loft angle and a user's shoulder and wrist and the club head are at the correct angle to hit the golf shot. The alignment angle of the club comprises the preselected angle 410 as selected by the user with the angle indicator 120, such as described above. As shown in FIG. 6A, although the user is shown starting with the golf club 200 orthogonal to the ground, it should be appreciated that the club shaft may be placed forward and backward at address. Additionally, the starting position may require a different shaft lean as appropriately desired by the user.

Figure 6C:
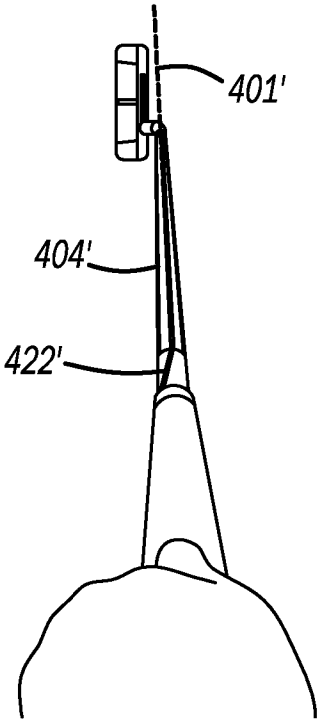
FIGS. 6C and 6D show a use of an alignment aid for a golf club for a left handed player, in accordance with the present technology.
Figure 6D:
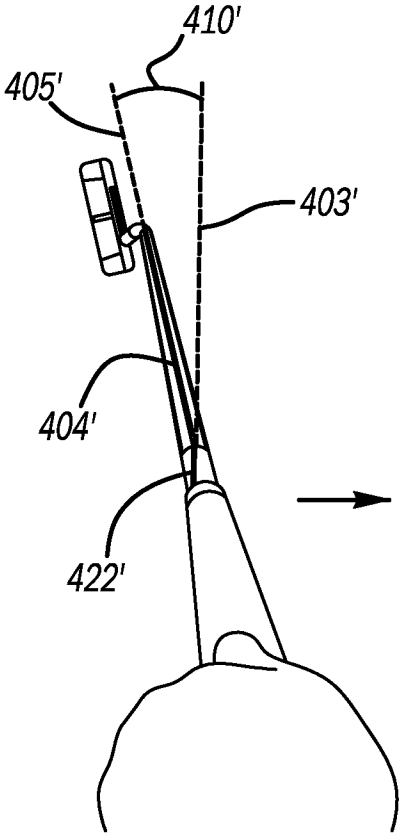

FIGS. 6C and 6D show a use of the alignment aid 100 for a golf club as viewed by a left handed user, to hit a closed face or press shot, such as described above. With the alignment aid 100, such as described above, a user addresses the golf ball before hitting golf shot. As shown within FIG. 6C, looking down a length of the golf club 200, the golf club 200 is orthogonal to the ground as indicated by the centerline marker 401' where the centerline marker 401' is orthogonal to the ground. The user tilts the golf club 200 toward the target to close the club loft angle. As indicated by the arrow and as shown in FIG. 6D, the user tilts the golf club 200 until the alignment line 422' of the angle indicator 120, as indicated by the line 403' is orthogonal to the ground. In this position, the golf club 200 comprises a closed loft angle and a user's shoulder and wrist and the club head are at the correct angle to hit the golf shot. As described above, the alignment angle of the club 200 comprises the preselected angle 410' as selected by the user with the angle indicator 120, such as described above. As shown in FIG. 5A, although the user is shown starting with the golf club 200 orthogonal to the ground, it should be appreciated that the club shaft may be placed forward and backward at address. Additionally, the starting position may require a different shaft lean as appropriately desired by the user.

In some embodiments, such as shown within FIGS. 7 and 8, the alignment aid 100 comprises one or more distance markers. The one or more distance markers enable the user to judge the distance of a golf ball to a target so that a user can hit a more accurate golf shot. For example, in some embodiments, one or more distance markers 611, 613, 615, and 617 are positioned on a back side of the alignment aid 100 and are seen on a back side of a golf club shaft 603. The one or more distance markers can be referenced by a user to judge a distance of a golf ball on the green or distance to other objects as needed. In some embodiments, this is done by placing an end of the golf grip 601 of the golf club 600 on the ground. In this configuration, the user can use the one or more distance markers 611, 613, 615, and 617 as marker to judge the distance of the golf ball. Using line of sight, a user can line up the golf ball with one of the one or more distance markers 611, 613, 615, and 617 on the golf club 600, to calculate a reasonable distance. The alignment aid can also be configured to allow a user to flip the golf club 600 upside down and place the grip end on the ground and use the line of sight 610 to look at the golf ball. Based on which distance marker lines up with the golf ball while the user is kneeling and/or eye level with the correct hash mark, the user can quickly and better judge the distance of the golf ball to the hole and/or the desired target. In some embodiments, the alignment aid 100 comprises 2 different sets of marks. The first set of marks can judge a distance the ball distance and the other can be used to judge flag distance. In some embodiments, the two sets of marks comprise different colors. However, the two marks can be differentiated in any appropriately desired manner.

FIG. 9 shows a method of aligning a golf club to a preselected shot angle when hitting a golf ball on a surface, in accordance with the present technology. As shown with FIG. 9, in the step 702, a shot angle is chosen. Then, in the step 704, a preselected shot angle indicator is placed onto a golf club. The preselected shot angle indicator points to an alignment angle marker disposed on the golf club, which indicates the preselected shot angle. In the step 706, a user addresses the golf ball, and in the step 708, the golf club shaft is tilted toward a target until the preselected shot angle indicator is orthogonal to the surface. In some embodiments, tilting the club shaft toward to the target changes the loft angle of the club face and closes the club face of the golf club. The centerline marker, the alignment angle marker and the angle indicator can be attached to the golf club by an end user. In some embodiments, the centerline marker and the alignment angle marker are disposed on the golf club during manufacture of the golf club. In some embodiments, the one or more alignment angle markers are one of printed on, pressed into, and a decal that is fitted into a recess of a grip of the golf club. The golf club can comprise one of a driver, a wood, a hybrid club, an iron, a wedge, and a putter.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A golf club alignment system, comprising:

a golf club including a golf club grip, a golf club shaft, and a golf club head;

a centerline marker disposed on the golf club shaft, wherein the centerline marker indicates a centerline of the golf club shaft;

a plurality of alignment angle markers disposed on the golf club including alignment angle lines and alignment angle marks, each of the alignment angle lines and the alignment angle marks being offset at an angle from the centerline; and an angle indicator disposed over one of the alignment angle lines and coupling both the centerline marker at a first end and one of the alignment angle marks at a second opposite end, wherein the angle indicator indicates a preselected club angle for a user.

2. The golf club alignment system of claim 1, wherein the centerline marker, the plurality of alignment angle markers and the angle indicator comprise one or more stickable decals.

3. The golf club alignment system of claim 1, wherein the centerline marker, the plurality of alignment angle markers, and the angle indicator are attached to the golf club by an end user.

4. The golf club alignment system of claim 1, wherein the centerline marker, the plurality of alignment angle markers and the angle indicator are permanently affixed to the golf club.

5. The golf club alignment system of claim 1, wherein the plurality of alignment angle markers are one of printed on, pressed into, and a decal that is fitted into a recess of a grip of the golf club.

6. The golf club alignment system of claim 1, wherein the alignment system further comprises a club face indicator for indicating whether a face of the golf club is in an open position or a closed position.

7. The golf club alignment system of claim 1, wherein the golf club comprises one of a driver, a wood, a hybrid club, an iron, a wedge, and a putter.

8. A method of aligning a golf club to a preselected shot angle, the method comprising steps of:

providing a golf club including a golf club shaft;

providing a golf club alignment system including:

a centerline marker configured to be disposed on the golf club shaft, wherein the centerline marker indicates a centerline of the golf club shaft;

a plurality of alignment angle markers including alignment angle lines and alignment angle marks, each of the alignment angle lines and the alignment angle marks being offset at an angle from the centerline; and an angle indicator configured to be disposed over one of the alignment angle lines and couple the centerline marker at a first end and one of the alignment angle marks at a second opposite end, wherein the angle indicator indicates a preselected club angle for a user;

choosing a shot angle; and placing the shot angle indicator onto the shaft of the golf club, wherein the shot angle indicator is disposed over one of the alignment angle lines and coupling both to the centerline marker at a first end and one of the alignment angle marks at a second opposite end, which indicates a preselected shot angle.

9. The method of claim 8, wherein tilting the club shaft toward to the target changes a loft angle of the golf club.

10. The method of claim 8, wherein the centerline marker, the alignment angle marker and the angle indicator are attached to the golf club by an end user.

11. The method of claim 8, wherein the centerline marker and the alignment angle marker are disposed on the golf club during manufacture of the golf club.

12. The method of claim 8, wherein the plurality of alignment angle markers are one of printed on, pressed into, and a decal that is fitted into a recess of a grip of the golf club.

13. The method of claim 8, wherein the golf club comprises one of a driver, a wood, a hybrid club, an iron, a wedge, and a putter.

14. A method of hitting a golf ball on a surface at a preselected shot angle, the method comprising the steps of:

providing a golf club with a golf club shaft and a golf club alignment system, the alignment system including:

a centerline marker disposed on the golf club shaft, wherein the centerline marker indicates a centerline of the golf club shaft;

a plurality of alignment angle markers including alignment angle lines and alignment angle marks, each of the alignment angle lines and the alignment angle marks being offset at an angle from the centerline; and an angle indicator disposed over one of the alignment angle lines and coupling the centerline marker at a first end and one of the alignment angle marks at a second opposite end, wherein the angle indicator indicates the preselected club angle for a user addressing the golf ball; and tilting the golf club shaft in a direction toward a target until the shot angle indicator is orthogonal to the surface.

* * * * *